US007492329B2

(12) United States Patent
Wang et al.

(10) Patent No.: US 7,492,329 B2
(45) Date of Patent: Feb. 17, 2009

(54) COMPOSITE MATERIAL WITH CHIRPED RESONANT CELLS

(75) Inventors: Shih-Yuan Wang, Palo Alto, CA (US); Alexandre Bratkovski, Palo Alto, CA (US)

(73) Assignee: Hewlett-Packard Development Company, L.P., Houston, PA (US)

( * ) Notice: Subject to any disclaimer, the term of this patent is extended or adjusted under 35 U.S.C. 154(b) by 315 days.

(21) Appl. No.: 11/580,338

(22) Filed: Oct. 12, 2006

(65) Prior Publication Data

US 2008/0088524 A1 Apr. 17, 2008

(51) Int. Cl.
*H01Q 15/02* (2006.01)

(52) U.S. Cl. ..... 343/909; 343/700 MS; 343/756; 343/909; 343/911 R

(58) Field of Classification Search ..... 343/700 MS, 343/756, 909, 911 R
See application file for complete search history.

(56) References Cited

U.S. PATENT DOCUMENTS

| | | | | |
|---|---|---|---|---|
| 5,611,870 | A * | 3/1997 | Horne et al. | 136/253 |
| 6,791,432 | B2 * | 9/2004 | Smith et al. | 333/99 S |
| 6,933,812 | B2 * | 8/2005 | Sarabandi et al. | 333/219 |
| 7,009,565 | B2 * | 3/2006 | Pidwerbetsky et al. | 343/700 MS |
| 7,106,494 | B2 | 9/2006 | Osipov et al. | |
| 7,218,190 | B2 * | 5/2007 | Engheta et al. | 333/239 |
| 7,256,753 | B2 * | 8/2007 | Werner et al. | 343/909 |
| 2001/0038325 | A1 | 11/2001 | Smith et al. | |

(Continued)

FOREIGN PATENT DOCUMENTS

| | | |
|---|---|---|
| EP | 1286415 | 2/2003 |
| WO | WO01/71774 | 9/2001 |
| WO | WO03044897 A1 | 5/2003 |
| WO | WO2006023195 A2 | 3/2006 |
| WO | WO2006/055798 | 5/2006 |
| WO | WO2006/078658 | 7/2006 |

OTHER PUBLICATIONS

Bi, G., et. al.,"Theoretical Study of Chirped and Apodized Photonic Crystals," PIERS 2005 Abstracts,The Electromechanics Academy, ISBN: 1-933077-06-9, China (Aug. 2005).

(Continued)

*Primary Examiner*—Douglas W. Owens
*Assistant Examiner*—Chuc Tran

(57) ABSTRACT

A composite material comprising a dielectric material and a plurality of non-overlapping local resonant cell groups disposed across the dielectric material is described. Each local resonant cell group comprises a plurality of resonant cells that are small relative to a first wavelength of electromagnetic radiation that is incident upon the composite material. Each local resonant cell group has a spatial extent that is not larger than an order of the first wavelength. For each of the local resonant cell groups, the resonant cells therein are chirped with respect to at least one geometric feature thereof such that a plurality of different subsets of the resonant cells resonate for a respective plurality of wavelengths in a spectral neighborhood of the first wavelength. The composite material exhibits at least one of a negative effective permeability and a negative effective permittivity for each of the plurality of wavelengths in that spectral neighborhood.

20 Claims, 5 Drawing Sheets

U.S. PATENT DOCUMENTS

| | | | | |
|---|---|---|---|---|
| 2005/0221128 | A1 * | 10/2005 | Kochergin | 428/824 |
| 2006/0022875 | A1 | 2/2006 | Pidwerbetsky et al. | |
| 2006/0044212 | A1 | 3/2006 | Wang et al. | |
| 2006/0109540 | A1 | 5/2006 | Kueks et al. | |
| 2006/0125681 | A1 | 6/2006 | Smith et al. | |
| 2006/0152430 | A1 | 7/2006 | Seddon et al. | |
| 2008/0165079 | A1 * | 7/2008 | Smith et al. | 343/911 R |

OTHER PUBLICATIONS

Smith, D., et. al., "A Gradient Index Metamaterial," preprint dated Jul. 11, 2004, downloaded on Oct. 11, 2006 from http://arxiv.org/ftp/physics/papers/0407/0407063.pdf.

R A Shelby et al-"Microwave transmission through a two-dimensional, isotropic left-handed metamaterials"-Applied Physics Letters vol. 78 No. 4-Jan. 22, 2001-pp. 489-491.

* cited by examiner

COMPOSITE MATERIAL WITH CHIRPED RESONANT CELLS

FIELD

This patent specification relates generally to the propagation of electromagnetic radiation and, more particularly, to composite materials capable of exhibiting negative effective permeability and/or negative effective permittivity with respect to incident electromagnetic radiation.

BACKGROUND

Substantial attention has been directed in recent years toward composite materials capable of exhibiting negative effective permeability and/or negative effective permittivity with respect to incident electromagnetic radiation. Such materials, often interchangeably termed artificial materials or metamaterials, generally comprise periodic arrays of electromagnetically resonant cells that are of substantially small dimension (e.g., 20% or less) compared to the wavelength of the incident radiation. Although the individual response of any particular cell to an incident wavefront can be quite complicated, the aggregate response the resonant cells can be described macroscopically, as if the composite material were a continuous material, except that the permeability term is replaced by an effective permeability and the permittivity term is replaced by an effective permittivity. However, unlike continuous materials, the resonant cells have structures that can be manipulated to vary their magnetic and electrical properties, such that different ranges of effective permeability and/or effective permittivity can be achieved across various useful radiation wavelengths.

Of particular appeal are so-called negative index materials, often interchangeably termed left-handed materials or negatively refractive materials, in which the effective permeability and effective permittivity are simultaneously negative for one or more wavelengths depending on the size, structure, and arrangement of the resonant cells. Potential industrial applicabilities for negative-index materials include so-called superlenses having the ability to image far below the diffraction limit to $\lambda/6$ and beyond, new designs for airborne radar, high resolution nuclear magnetic resonance (NMR) systems for medical imaging, microwave lenses, and other radiation processing devices.

One issue that arises in the realization of useful devices from such composite materials, including negative index materials, relates to device bandwidth. In particular, issues arise in relation to the spectral width of incident radiation for which negative effective permeability and/or negative effective permittivity is achieved. Accordingly, it would be desirable to spectrally broaden such composite materials with respect to their negative index behaviors, negative effective permeability behaviors, and/or negative effective permittivity behaviors. It would be further desirable to provide such spectral broadening while also providing a uniformity of response across a surface of the composite material. It would be still further desirable to provide for equalization and/or amplification of the response of such composite materials across the broadened spectrum of operation. Other issues arise as would be apparent to one skilled in the art in view of the present disclosure.

SUMMARY

In one embodiment, a composite material is provided, comprising a dielectric material and a plurality of non-overlapping local resonant cell groups disposed across the dielectric material. Each local resonant cell group comprises a plurality of resonant cells that are small relative to a first wavelength of electromagnetic radiation that is incident upon the composite material. Each local resonant cell group has a spatial extent that is not larger than an order of the first wavelength. For each of the local resonant cell groups, the resonant cells therein are chirped with respect to at least one geometric feature thereof such that a plurality of different subsets of the resonant cells resonate for a respective plurality of wavelengths in a spectral neighborhood of the first wavelength. The composite material exhibits at least one of a negative effective permeability and a negative effective permittivity for each of the plurality of wavelengths in that spectral neighborhood.

Also provided is a spectrally broadened composite material, comprising a surface for receiving incident electromagnetic radiation within a spectral neighborhood of a first wavelength and a plurality of cell groups disposed across the surface. Each cell group comprises a plurality of electromagnetically reactive cells not larger than about one-fifth of the first wavelength. Each cell group has an area not larger than an order of a square of the first wavelength. For each of the cell groups, the electromagnetically reactive cells therein are chirped with respect to at least one geometric feature thereof such that a plurality of different subsets of the electromagnetically reactive cells in the cell group exhibit at least partially resonant behavior for a respective plurality of wavelengths in the spectral neighborhood of the first wavelength. The spectrally broadened composite material exhibits at least one of a negative effective permeability and a negative effective permittivity for each of the plurality of wavelengths in that spectral neighborhood.

Also provided is a method for propagating electromagnetic radiation having a plurality of wavelengths within a neighborhood of a first wavelength. The method comprises applying the electromagnetic radiation to a surface of a composite medium, the composite medium having a plurality of non-overlapping local resonant cell groups disposed across the surface, each local resonant cell group comprising a plurality of resonant cells that are small relative to the first wavelength. Each local resonant cell group has a spatial extent that is not larger than an order of the first wavelength. The resonant cells for each of the local resonant cell groups are chirped with respect to at least one geometric feature such that, for the plurality of wavelengths, a respective plurality of different subsets of the resonant cells resonate, the composite material exhibiting at least one of a negative effective permeability and a negative effective permittivity for the plurality of wavelengths.

DETAILED DESCRIPTION

Figure 1:
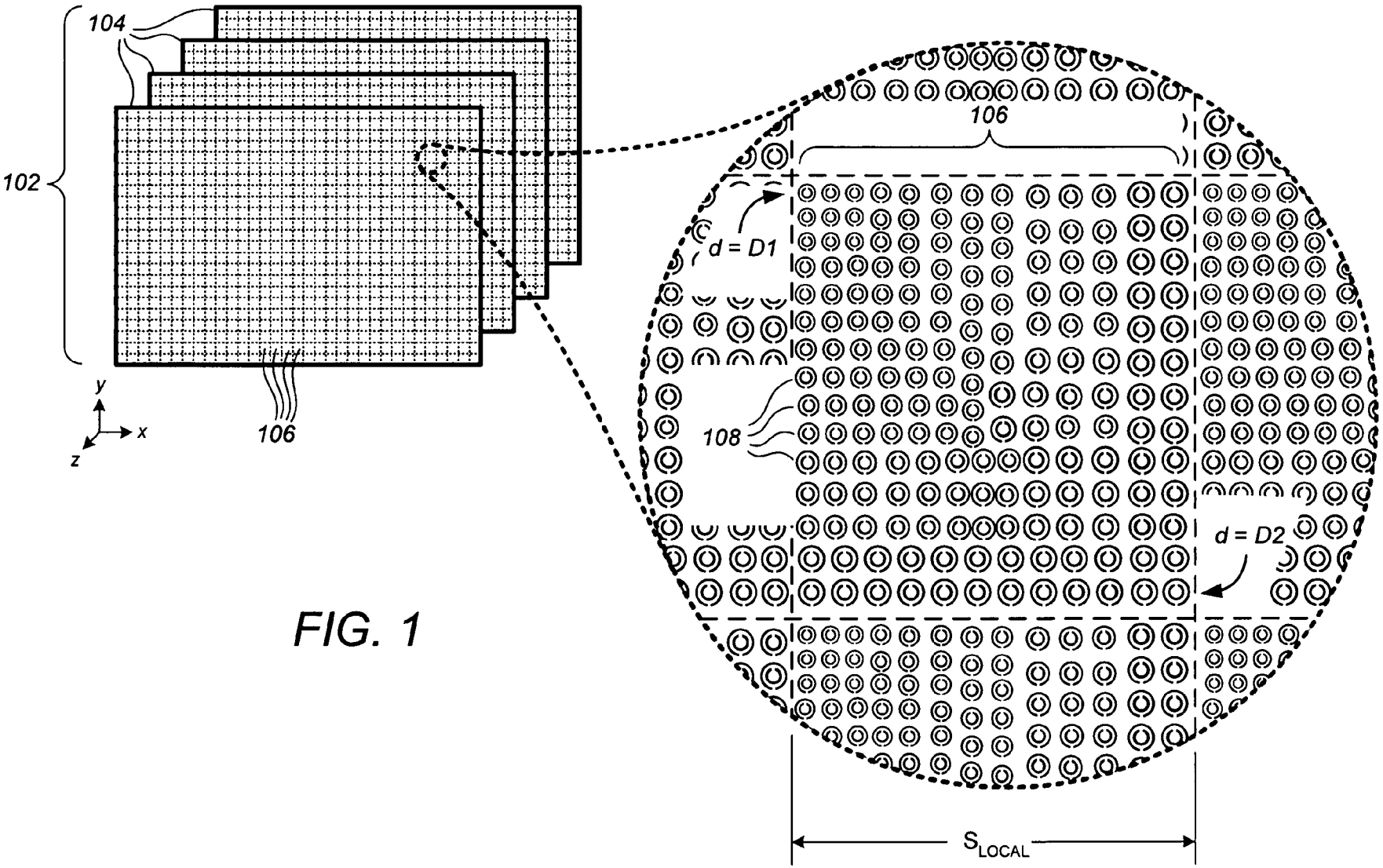
FIG. 1 illustrates a composite material according to an embodiment.

FIG. 1 illustrates a composite material 102 according to an embodiment. Composite material 102 comprises at least one surface 104 capable of receiving incident electromagnetic radiation. The surface 104 typically comprises a dielectric substrate such as silicon, although any of a variety of different dielectric materials may be used. By way of example and not by way of limitation, the incident electromagnetic radiation may originate from the positive-z side of the composite material 102 of FIG. 1, propagate generally toward the negative-z direction, and have a wave normal at any of a variety of angles relative to the z-axis.

Composite material 102 comprises a plurality of local resonant cell groups 106 spatially arranged across the surface 104. Each local resonant cell group 106 comprises a plurality of electromagnetically reactive cells or resonant cells 108 that are small relative to a wavelength of the incident electromagnetic radiation for which the negative effective permeability and/or negative effective permittivity is to be exhibited. In one example, each resonant cell 108 is smaller than about ⅕ such wavelength, with even better response occurring when each resonant cell 108 is smaller than about 1/10 such wavelength. In the particular example of FIG. 1, the resonant cells 108 comprise circular split-ring resonators formed from a highly conductive material such as gold or silver disposed upon the dielectric surface 104, although any of a variety of different resonant cell types may be used. According to an embodiment, for each resonant cell group 106, the resonant cells 108 therein are chirped with respect to at least one geometric feature between a first value of that feature and a second value of that feature. Thus, by way of example, the resonant cells 108 have diameters "d" that are chirped between a first value D1 and a second value D2, as shown in FIG. 1.

Figure 2C:
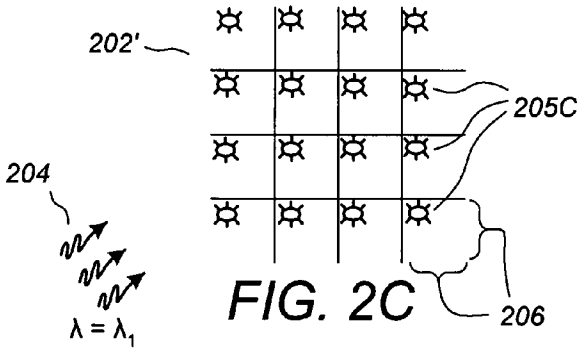
FIGS. 2C-2E illustrate conceptual diagrams of a composite material receiving electromagnetic radiation at different wavelengths according to an embodiment.
Figure 2D:
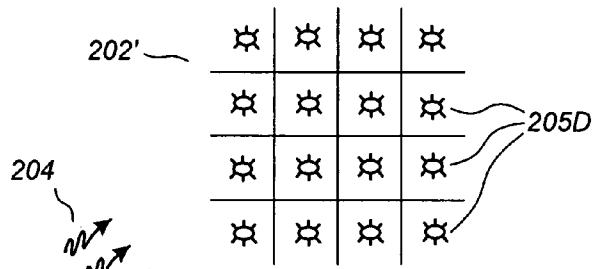
Figure 2E:
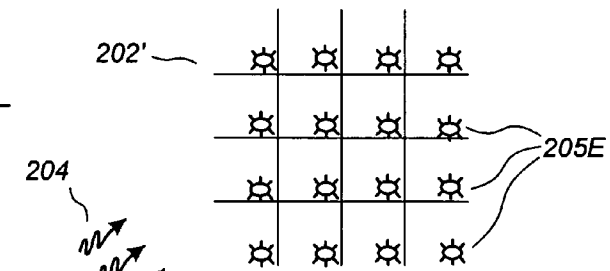
Figure 2A:
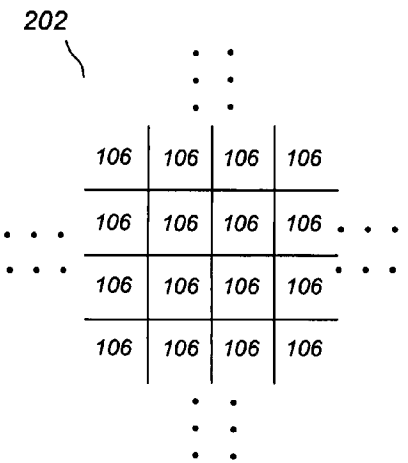
FIGS. 2A-2B illustrate a composite material according to an embodiment and a spectrum of electromagnetic radiation incident thereon.
Figure 2B:
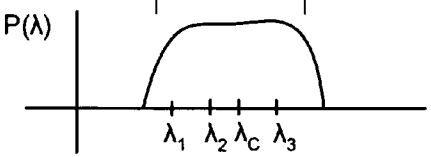

FIG. 2A illustrates a regional segment 202 across the surface 104 of the composite material 102, the regional segment 202 comprising non-overlapping, substantially identical, spatially tiled versions of the local resonant cell group 106. FIG. 2B illustrates a typical spectrum of electromagnetic radiation that may be incident upon the composite material 102 and within which the negative effective permeability and/or negative effective permittivity is desired, comprising a first wavelength $\lambda_C$ (which may be, but is not required to be, a center wavelength) and a spectral neighborhood 203 around the first wavelength $\lambda_C$, the spectral neighborhood including a plurality of wavelengths $\lambda_1$, $\lambda_2$, and $\lambda_3$.

By way of example and not by way of limitation, it may be desired for the composite material 102 to form a component of a piece of optical processing hardware in a wavelength division multiplexed (WDM) fiber optic communications system. In a non-spectrally broadened case, the negative effective permeability and/or negative effective permittivity behaviors being harnessed in that piece of hardware might be limited to an unacceptably narrow wavelength range at a particular wavelength such as 1520 nm. However, in a spectrally broadened case in which at least one geometric feature of the resonant cells 108 is chirped according to an embodiment, the negative effective permeability and/or negative effective permittivity behaviors may be harnessed for a plurality of wavelengths across a more appreciable spectral neighborhood 203, such as a 20-nm or 40-nm wide neighborhood, around that particular wavelength. The location and width of the spectral neighborhood 203 is dependent on the choice of materials, the resonant cell type, the choice of geometrical feature to be chirped, the number of levels to be chirped, and related factors to be determined by simulation and/or empirically using known methods, such determinations being achievable by a person skilled in the art in view of the present teachings without undue experimentation. It is to be appreciated that although certain examples are presented herein for an infrared wavelength range, embodiments in which the spectral neighborhood range 203 is in any of a microwave, infrared, or optical wavelength range are within the scope of the present teachings.

According to an embodiment, the local resonant cell groups 106 have a spatial extent, such as the length $S_{LOCAL}$ shown in FIG. 1, that is not greater than an order of the first wavelength $\lambda_C$. For one embodiment, order refers to about a factor of ten, i.e., the spatial extent $S_{LOCAL}$ is not greater than about ten times the first wavelength $\lambda_C$. For another embodiment, the spatial extent $S_{LOCAL}$ is not greater than about two times the first wavelength $\lambda_C$. For still another embodiment, the spatial extent $S_{LOCAL}$ is not greater than about the first wavelength $\lambda_C$. For still another embodiment, the local resonant cell groups 106 each occupy an area less than about one square of the first wavelength $\lambda_C$. For yet another embodiment, the local resonant cell groups 106 each occupy an area less than an order of a square of the first wavelength $\lambda_C$. It is to be appreciated that the resonant cell groups 106 can take on a variety of different contiguous shapes (e.g., triangular, hexagonal, irregular blob-like shapes, and so on), and are not limited to squares or rectangles in shape. For one embodiment, spatial extent refers to a length along a major dimension for shapes that are irregular, oblong, or of a non-unity aspect ratio.

Generally speaking, as the spatial extent of each local resonant cell groups 106 is made smaller, a more uniform response across the surface 104 as "seen" by the incident electromagnetic radiation is provided. At the same time, the spatial extent of each local resonant cell group 106 should be sufficiently large to accommodate a sufficient number of resonant cells 108 to contain enough different levels for the geometric feature being chirped. A spatial extent $S_{LOCAL}$ of about the first wavelength $\lambda_C$ provides one particularly good tradeoff between the spatial uniformity of the response and the number of chirp levels of the at least one geometric feature, the number of chirp levels in turn relating to an amount of spectral broadening that can be achieved.

Further to the non-limiting example supra for a WDM optical wavelength range, the spatial extent $S_{LOCAL}$ may be about 1.5 μm and the resonant cells 108 may be spatially scaled versions of each other with their diameters chirped at 5-10 different levels between, for example, 100 nm and 150 nm. However, it is to be appreciated that any of a variety of other geometric features may be chirped alternatively to, or in conjunction with, the spatial scale. Examples of such other geometric features include, but are not limited to, pattern shape, pattern aspect ratio, pattern type, conductor thickness, and resonant cell spacing. The number of levels of chirping may be in the tens or hundreds of levels, or may alternatively be as few as two or three levels, without departing from the scope of the present teachings.

FIGS. 2C-2E illustrate conceptual diagrams of a regional segment 202' of a composite material according to an embodiment as it receives incident radiation 204 at a respective plurality of wavelengths $\lambda_1$, $\lambda_2$, and $\lambda_3$ within the spectral neighborhood 203 shown in FIG. 2B. The regional segment 202' comprises a tiled plurality of local resonant cell groups 206 that may each be similar to the local resonant cell group 106 of FIG. 1, supra. Drawings of the individual resonant cells of the local resonant cell groups 206 are omitted from FIGS. 2C-2E for clarity of presentation. Referring now to FIG. 2C for which wavelength $\lambda_1$ is incident, within each local resonant cell group 206 there will be a first subset 205C of resonant cells that are at least partially resonant for the wavelength $\lambda_1$. With reference to FIG. 2D, for which a second wavelength $\lambda_2$ in the spectral neighborhood 203 is incident, there will be a second subset 205D that is at least partially resonant. With reference to FIG. 2E, for which a third wavelength $\lambda_3$ in the spectral neighborhood 203 is incident, there will be a third subset 205E that is at least partially resonant. Particularly for embodiments in which the local resonant cell groups 206 are tiled and of limited spatial extent on the order of a wavelength or less, there is an appreciably uniform negative effective permeability and/or negative effective permittivity characteristic "seen" across the regional segment 202' for each wavelength $\lambda_1$, $\lambda_2$, and $\lambda_3$.

Figure 4B:
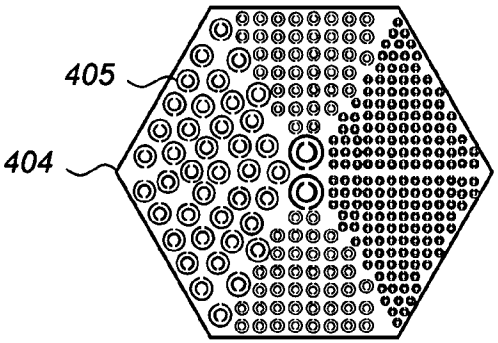
FIGS. 4A-4E illustrate examples of resonant cell groups according to one or more embodiments.

For the particular example of FIGS. 2C-2E, it is presumed that the at least one geometric feature that is chirped is spatially varied in a continuous manner, such that the subset of resonating cells within each local resonant cell group 206 tends to migrate thereacross (205C→205D→205E) as the wavelength is changed. Moreover, the at least one geometric feature that is chirped for FIGS. 2C-2E is presumed to have a particular degree and layout of the chirped variation such that the migrating subsets are contiguous and retain their size and shape as they migrate thereacross. This type of consistency, in which the different wavelengths "see" the same response, except for a lateral shift, can be useful for any of a variety of optical processing applications. The particular degree and layout of the chirped resonant cells to achieve such responses would be readily achievable by a person skilled in the art in view of the present teachings without undue experimentation. Simplified examples of such layout of the chirped resonant cells are illustrated in FIGS. 4A and 4E, infra. However, the scope of the present teachings extends to any of a variety of spatially continuous or discontinuous chirping strategies for the at least one geometric feature of the resonant cells.

Figure 3A:
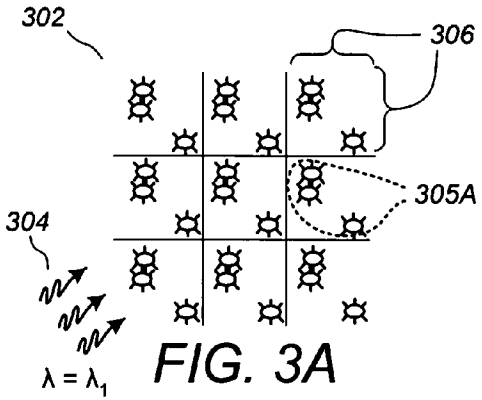
FIGS. 3A-3B illustrate conceptual diagrams of a composite material receiving electromagnetic radiation at different wavelengths according to an embodiment.
Figure 3B:
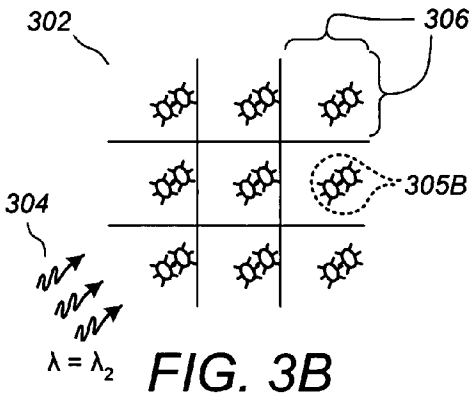

FIGS. 3A-3B illustrate conceptual diagrams of a regional segment 302 of a composite material, the regional segment 302 comprising tiled versions of a same local resonant cell group 306 according to an embodiment. For this embodiment, it is presumed that the at least one geometric feature that is chirped is spatially varied in a discontinuous manner, wherein the subset of resonating cells within each local resonant cell group 306 changes significantly in size, shape, number, and/or location from one wavelength to the next. Thus, for a first wavelength $\lambda_1$ (FIG. 3A) there is a first subset 305A of resonating cells appearing in three clusters as shown, while for second wavelength $\lambda_2$ (FIG. 3B) there is a second subset 305B of resonating cells appearing in two clusters at different locations as shown.

Figure 4D:
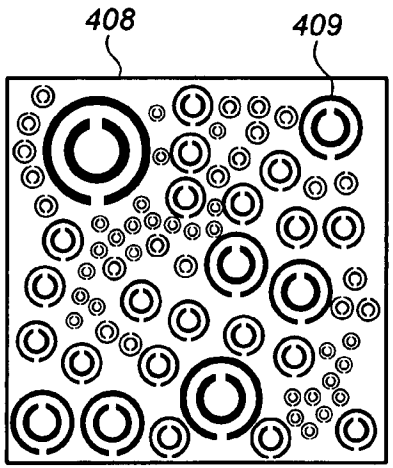
Figure 4A:
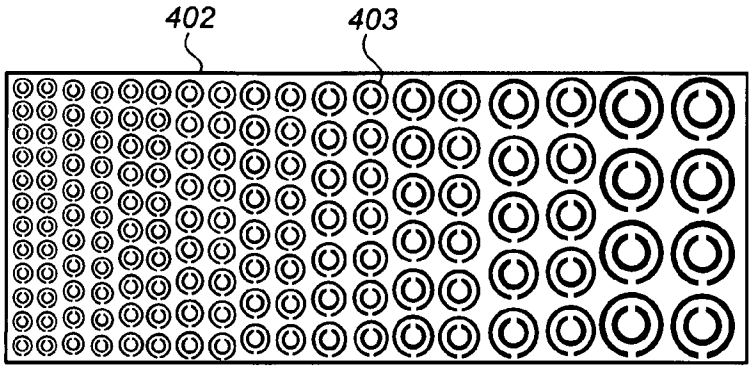

The particular example of FIGS. 3A-3B presumes that the at least one geometric feature that is chirped is spatially varied in a random or quasi-random manner (see, e.g., FIG. 4D, infra). The term "chirped" nevertheless applies because, even though not spatially continuous relative to the chirped characteristic, the population of resonant cells is parametrically chirped with respect to the chirped geometric feature. For other embodiments, the at least one geometric feature that is chirped is spatially varied in a manner that is spatially regular (i.e. forming a pattern of some type), but discontinuous (see, e.g., FIG. 4C, infra). For the regular/patterned case, the subsets of resonating cells within any particular local resonant cell group would appear regular or periodic, although the nature of that regularity or periodicity may change significantly among the different wavelengths. For both the random and the regular/periodic cases, by virtue of the tiled local resonant cell groups 306, there is invariably an overlying periodicity on the order of one wavelength or less across the surface of the composite material to facilitate a uniformity of response for each of the wavelengths $\lambda_1$, $\lambda_2$, and $\lambda_3$.

Figure 4C:
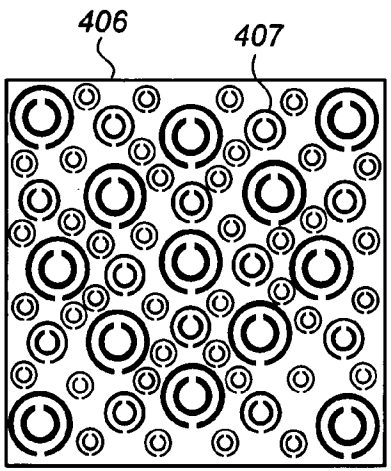
Figure 4E:
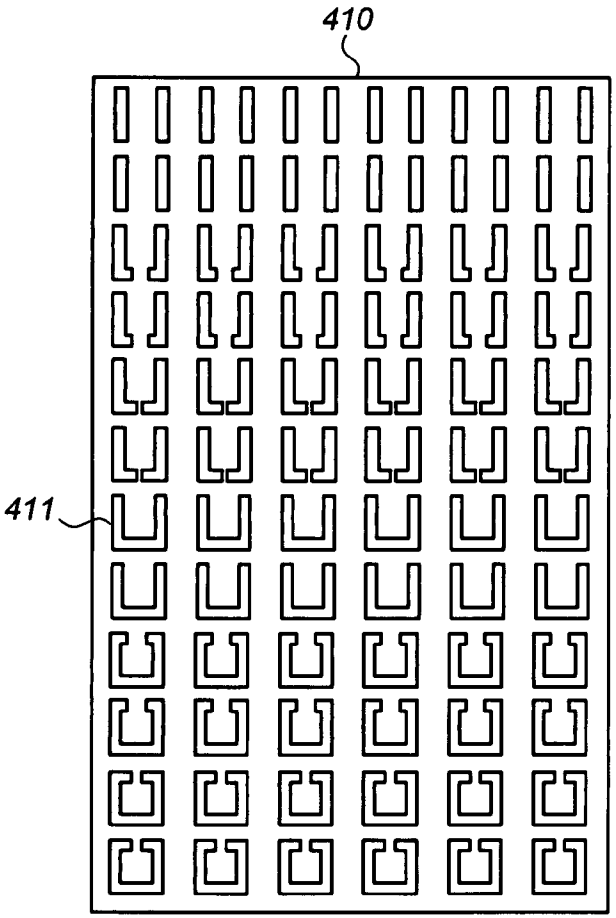

FIGS. 4A-4E illustrate some of the wide variety of local resonant cell groups that may be incorporated into a composite material according to one or more embodiments. Local resonant cell group 402 of FIG. 4A is rectangular in shape and comprises circular split-ring resonators 403 whose scale is chirped in a spatially continuous manner from a first end to a second end. Local resonant cell group 404 of FIG. 4B is hexagonal in shape and comprises circular split-ring resonators 405 whose scale is chirped in a stepped continuous manner by angular sector. Local resonant cell group 406 of FIG. 4C is square in shape and comprises circular split-ring resonators 407 whose scale is chirped in a spatially discontinuous but regular/patterned manner (albeit a rather complex pattern). Local resonant cell group 408 of FIG. 4D is square in shape and comprises circular split-ring resonators 409 whose scale is chirped in a spatially random manner. Local resonant cell group 410 of FIG. 4E is rectangular in shape and comprises resonant cells 411 that are chirped in type between open ring resonators at one end (bottom) to parallel nanowires/bars at the other end (top), the chirped characteristic being spatially continuous across the local resonant cell group 410.

Figure 5:
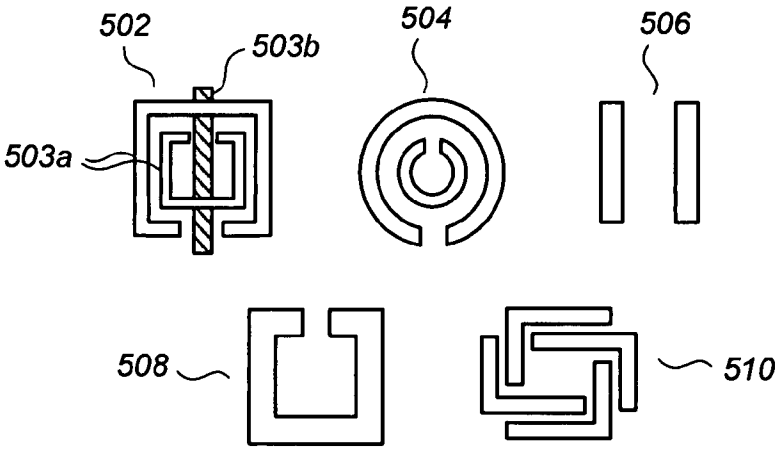
FIG. 5 illustrates examples of resonant cells according to one or more embodiments.

FIG. 5 illustrates some of the many different resonant cell types that may be used in conjunction with one or more embodiments. The resonant cell 502 comprises a square split-ring resonator structure 503*a* together with a linear conductor element 503*b*, the linear conductor 503*b* facilitating achievement of a negative effective permittivity near the resonant frequency. The resonant cell 504 comprises a circular split-ring resonator, the resonant cell 506 comprises a parallel nanowire/bar resonator, the resonant cell 508 comprises a square open ring resonator, and the resonant cell 510 comprises a quartet of rotated L-shaped conductors.

One advantage provided by each of the embodiments supra is that spectral broadening is achieved using passive components. However, it is to be appreciated that providing gain in conjunction with spectral broadening is also within the scope of the present teachings, as described further hereinbelow.

Figure 6:
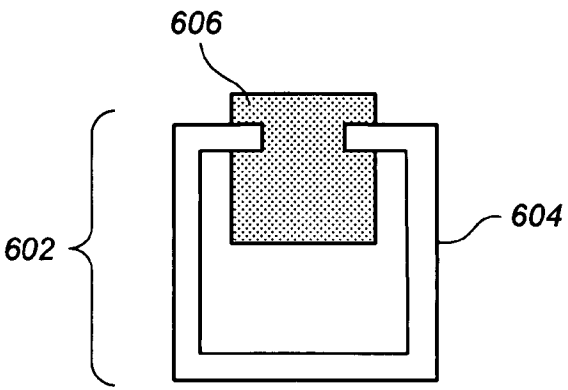
FIG. 6 illustrates a resonant cell according to an embodiment.

FIG. 6 illustrates a resonant cell 602 having a gain characteristic that can be chirped and at least one geometric feature that can be chirped according to an embodiment. The resonant cell 602 comprises a square open-ring conductor 604 and an optical gain medium 606. The optical gain medium 606 is optically pumped from an external pump source (not shown) and has an amplification band that includes the spectral neighborhood 203 (see FIG. 2B, supra) of the incident electromagnetic radiation, for providing gain for each of the plurality of wavelengths $\lambda_1$, $\lambda_2$, and $\lambda_3$ therein.

The optical gain medium 606 may be integrated into the dielectric structure (not shown) that supports the resonant cell 602. By way of example and not by way of limitation, where the spectral neighborhood 203 is in the WDM wavelength range, the optical gain medium 606 can comprise bulk active InGaAsP and/or multiple quantum wells according to a InGaAsP/InGaAs/InP material system. In the latter case, the dielectric support structure can comprise a top layer of p-InP material 100 nm thick, a bottom layer of n-InP material 100 nm thick, and a vertical stack therebetween comprising 5-12 (or more) repetitions of undoped InGaAsP 6 nm thick on top of undoped InGaAs 7 nm thick. Examples of other resonant cells having one of a geometric and gain characteristic that can be spatially varied can be found in one or more of the following commonly assigned applications, each of which is incorporated by reference herein: US 2006/0044212A1; US2006/0109540A1; and Ser. No. 11/285,910, filed Nov. 23, 2005.

Figure 7:
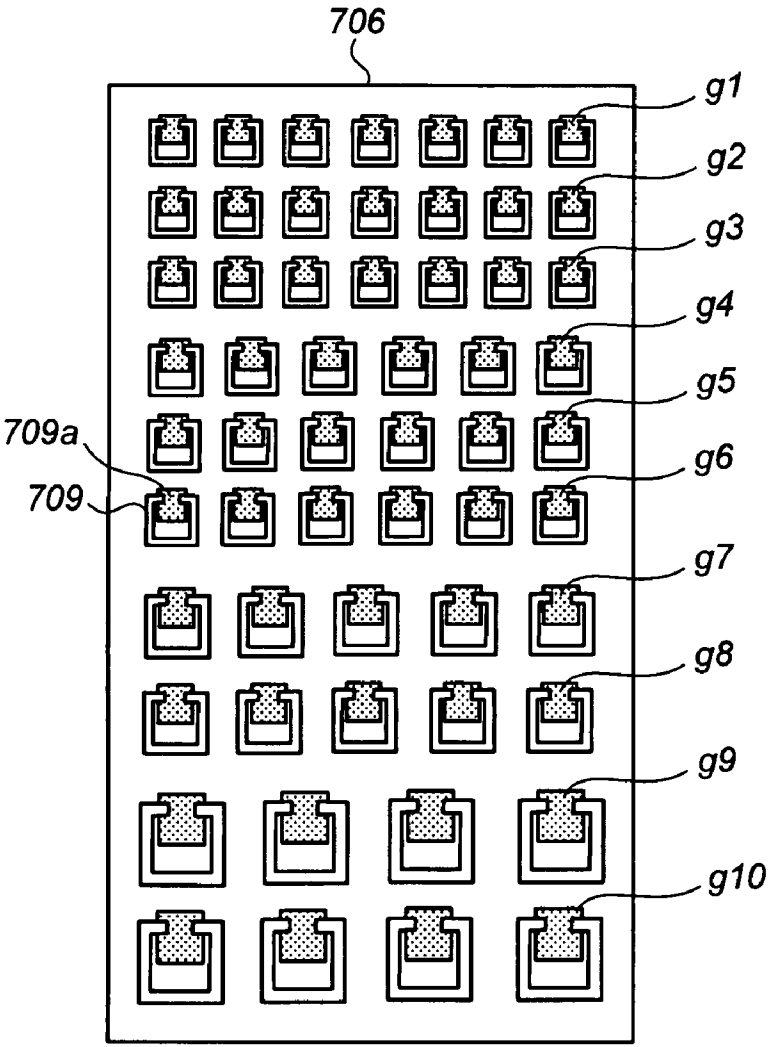
FIG. 7 illustrates a resonant cell group according an embodiment.

FIG. 7 illustrates a local resonant cell group 706 according to an embodiment, which can be spatially tiled across a surface to form a composite material according to an embodiment. The local resonant cell group 706 comprises a plurality of resonant cells 709 that are chirped with respect to at least one geometric feature in a manner analogous to the embodiments of FIGS. 1-5, supra. Notably, although the chirped characteristic (scale) is spatially varied in a continuous manner for the embodiment of FIG. 7, in other embodiments one or more of the previously described discontinuous spatial variations can be incorporated. Each resonant cell 709 further comprises an associated gain medium 709*a* to provide gain within the spectral neighborhood of interest.

According to an embodiment, at least one characteristic of the optical gain medium 709*a* is also chirped within the local cell group 706 to provide chirped amounts of gain among the resonant cells 709, illustrated as g1-g10 in FIG. 7. Generally speaking, because the resonant cells of a common local resonant cell group will often be very close to each other relative to a wavelength of the pump radiation, with spatial control of the pump light intensity among the resonant cells correspondingly difficult to achieve, in one embodiment the spatial variations in gain arise from intrinsic, structural differences in the gain media. For this embodiment, the amount of gain provided by each optical gain medium 709*a* can be varied by varying the absolute optical gain medium size, the relative optical gain medium size compared to the associated resonant cell size, and the semiconductor doping level of the optical gain medium (including that of quantum dots where quantum dots are used as the optical gain medium).

For one embodiment, the chirped amounts of gain g1-g10 are adjusted to equalize a response of the composite material for the spectral neighborhood of interest. Thus, for example, where the response of the resonant cell group 706 would be stronger for A than for $\lambda_2$ ($\lambda_2>\lambda_1$) in the absence of any gain material, which corresponds to certain groups of larger resonant cells being "weaker" than certain groups of smaller resonant cells, the gain provided to the larger resonant cells can be increased so as to equalize the responses at $\lambda_1$ and $\lambda_2$.

Whereas many alterations and modifications of the embodiments will no doubt become apparent to a person of ordinary skill in the art after having read the foregoing description, it is to be understood that the particular embodiments shown and described by way of illustration are in no way intended to be considered limiting. By way of example, although many of the chirped geometric feature(s) of the resonant cells described supra affect effective permeability, in a wide range of other embodiments the chirped geometric feature(s) relate to aspects of the resonant cells affecting effective permittivity, such as the lengths of linear conductors, or the lengthwise dimensions of parallel bar/nanowire resonant cell conductors. Moreover, although the resonant cells primarily comprise two-dimensional conductor patterns in many of the embodiments supra, in other embodiments the resonant cells are three-dimensional (e.g., for increased isotropy), and one or more vertical out-of-plane geometric features are chirped within each local resonant cell group. Thus, reference to the details of the described embodiments are not intended to limit their scope.

What is claimed is:

1. A composite material, comprising:

a dielectric material; and a plurality of non-overlapping local resonant cell groups disposed across said dielectric material, each local resonant cell group comprising a plurality of resonant cells that are small relative to a first wavelength of electromagnetic radiation incident upon said composite material, each local resonant cell group having a spatial extent that is not larger than an order of said first wavelength;

wherein, for each of said local resonant cell groups, the resonant cells therein are chirped with respect to at least one geometric feature thereof such that a plurality of different subsets of the resonant cells resonate for a respective plurality of wavelengths in a spectral neighborhood of said first wavelength, said composite material exhibiting at least one of a negative effective permeability and a negative effective permittivity for each of said plurality of wavelengths in said spectral neighborhood.

2. The composite material of claim 1, each of said resonant cells comprising a pattern of electrical conductors, wherein the at least one geometric feature that is chirped is selected from the group consisting of: pattern scale, pattern shape, pattern aspect ratio, pattern type, conductor thickness, and resonant cell spacing.

3. The composite material of claim 1, wherein said local resonant cell groups are substantially identical and are tiled across said dielectric material, whereby a correspondingly tiled pattern of said resonating subsets of resonant cells is formed across said dielectric material for each of said plurality of wavelengths in said spectral neighborhood.

4. The composite material of claim 3, wherein each of said local resonant cell groups has an area less than a square of said first wavelength, and wherein each of said resonant cells is smaller than one-fifth of said first wavelength.

5. The composite material of claim 3, wherein said at least one geometric feature is chirped in a spatially continuous manner across each of said local resonant cell groups such that said correspondingly tiled pattern of said resonating subsets of resonant cells remains substantially constant, except for a lateral shift, for different ones of said plurality of wavelengths.

6. The composite material of claim 3, wherein said at least one geometric feature is chirped in a spatially discontinuous but regular manner across each of said local resonant cell groups.

7. The composite material of claim 3, wherein said at least one geometric feature is chirped in a spatially random or quasi-random manner across each of said local resonant cell groups.

8. The composite material of claim 1, further comprising an optical gain medium for each of said resonant cells, the optical gain medium configured to provide gain for each of said plurality of wavelengths in said spectral neighborhood.

9. The composite material of claim 8, wherein at least one characteristic of the optical gain medium is chirped among the resonant cells in each of said local cell groups to provide chirped amounts of gain among the resonant cells.

10. The composite material of claim 9, wherein said chirped amounts of gain and said at least one geometric resonant cell feature that is chirped are adjusted to equalize a response of said composite material for said plurality of wavelengths in said spectral neighborhood.

11. The composite material of claim 9, wherein the at least one characteristic of the optical gain medium that is chirped is selected from the group consisting of: absolute optical gain medium size, relative optical gain medium size compared to resonant cell size, and semiconductor doping level.

12. A spectrally broadened composite material, comprising:

a surface for receiving incident electromagnetic radiation within a spectral neighborhood of a first wavelength; and a plurality of cell groups disposed across said surface, each cell group comprising a plurality of electromagnetically reactive cells not larger than about one-fifth of said first wavelength, each cell group having an area not larger than an order of a square of said first wavelength;

wherein, for each of said cell groups, the electromagnetically reactive cells therein are chirped with respect to at least one geometric feature thereof such that a plurality of different subsets of the electromagnetically reactive cells in said cell group exhibit at least partially resonant behavior for a respective plurality of wavelengths in said spectral neighborhood, wherein said spectrally broadened composite material exhibits at least one of a negative effective permeability and a negative effective permittivity for each of said plurality of wavelengths in said spectral neighborhood.

13. The spectrally broadened composite material of claim 12, wherein each cell group has an area not larger than about one square of said first wavelength.

14. The spectrally broadened composite material of claim 12, each of said electromagnetically reactive cells comprising a pattern of electrical conductors, wherein the at least one geometric feature that is chirped is selected from the group consisting of: pattern scale, pattern shape, pattern aspect ratio, pattern type, conductor thickness, and spacing between electromagnetically reactive cells.

15. The spectrally broadened composite material of claim 12, wherein said cell groups are substantially identical and are tiled across said surface, whereby a correspondingly tiled pattern of said at least partially resonating subsets of electromagnetically reactive cells is formed across said surface for each of said plurality of wavelengths in said spectral neighborhood.

16. The spectrally broadened composite material of claim 12, wherein said at least one geometric feature is chirped in one of a spatially continuous manner, a spatially discontinuous but regular manner, a spatially random manner, and a spatially quasi-random manner across each of said cell groups.

17. The spectrally broadened composite material of claim 12, further comprising an optical gain medium providing gain for each of said electromagnetically reactive cells by an amount that is adjusted to equalize a response of said composite material for said plurality of wavelengths in said spectral neighborhood.

18. A method for propagating electromagnetic radiation having a plurality of wavelengths within a neighborhood of a first wavelength, comprising applying the electromagnetic radiation to a surface of a composite medium, the composite medium having a plurality of non-overlapping local resonant cell groups disposed across the surface, each local resonant cell group comprising a plurality of resonant cells that are small relative to the first wavelength, each local resonant cell group having a spatial extent that is not larger than an order of the first wavelength, the resonant cells for each of the local resonant cell groups being chirped with respect to at least one geometric feature such that a respective plurality of different subsets of the resonant cells resonate for said plurality of wavelengths, wherein the composite material exhibits at least one of a negative effective permeability and a negative effective permittivity for each of said plurality of wavelengths.

19. The method of claim 18, wherein the local resonant cell groups are substantially identical and are tiled across the surface such that a correspondingly tiled pattern of resonating subsets of resonant cells is formed across the surface for each of said plurality of wavelengths.

20. The method of claim 19, wherein each of said local resonant cell groups has an area less than a square of the first wavelength, and wherein each of said resonant cells has a major dimension that is less than one-fifth of the first wavelength.

* * * * *

UNITED STATES PATENT AND TRADEMARK OFFICE

CERTIFICATE OF CORRECTION

PATENT NO. : 7,492,329 B2
APPLICATION NO. : 11/580338
DATED : February 17, 2009
INVENTOR(S) : Shih-Yuan Wang et al.

It is certified that error appears in the above-identified patent and that said Letters Patent is hereby corrected as shown below:

On the face page, in field (73), in "Assignee", in column 1, line 2, delete "PA" and insert -- TX --, therefor.

In column 7, line 43, delete "A" and insert -- $\lambda_1$ --, therefor.

In column 7, line 47, delete "$\lambda_l$" and insert -- $\lambda_1$ --, therefor.

Signed and Sealed this

Fourteenth Day of July, 2009

John Doll

JOHN DOLL
*Acting Director of the United States Patent and Trademark Office*